US011141349B1

(12) United States Patent
Chen

(10) Patent No.: US 11,141,349 B1
(45) Date of Patent: Oct. 12, 2021

(54) STRUCTURE WITH LID, AND STORAGE CONTAINER

(71) Applicant: Changsha Yuwen Network Technology Co., Ltd., Changsha (CN)

(72) Inventor: Junyuan Chen, Changsha (CN)

(73) Assignee: CHANGSHA YUWEN NETWORK TECHNOLOGY CO., LTD., Changsha (CN)

( * ) Notice: Subject to any disclaimer, the term of this patent is extended or adjusted under 35 U.S.C. 154(b) by 0 days.

(21) Appl. No.: 17/029,342

(22) Filed: Sep. 23, 2020

(30) Foreign Application Priority Data

Sep. 10, 2020 (CN) ..... 202021978477.4

(51) Int. Cl.
*A61J 1/14* (2006.01)
*A61J 1/03* (2006.01)

(52) U.S. Cl.
CPC ..... *A61J 1/1412* (2013.01); *A61J 1/03* (2013.01)

(58) Field of Classification Search
CPC ..... A61J 1/1412; A61J 1/03
USPC ..... 206/540, 528
See application file for complete search history.

(56) References Cited

U.S. PATENT DOCUMENTS 2,492,864 A * 12/1949 Hermani ..... B65D 43/164 206/540
4,133,449 A * 1/1979 Ostrowsky ..... B65D 43/162 206/540
4,730,731 A * 3/1988 Allison ..... B65D 50/045 206/1.5
5,520,885 A * 5/1996 Coelho ..... A61J 1/1412 422/255
6,454,115 B1 * 9/2002 Allasia ..... B65D 43/162 206/540
8,251,218 B2 * 8/2012 Gelardi ..... B65D 83/0481 206/540
2015/0298895 A1 * 10/2015 Corbett ..... B65D 77/06 206/540

* cited by examiner

*Primary Examiner* — Jacob K Ackun
(74) *Attorney, Agent, or Firm* — IPro, PLLC

(57) ABSTRACT

A structure with a lid includes a lid body, a cartridge main body, and an elastic member. A first end of the lid body is rotatably connected to the cartridge main body. A first engaging portion is arranged at the lid body, a second engaging portion is arranged at the cartridge main body, a pressing portion is connected to an outer side of the second engaging portion which is elastically deformed outwards when it's pressed. A first retaining slot is arranged at a bottom of the lid body, a second retaining slot is arranged at a top of the cartridge main body, and the elastic member are disposed in the retaining slots, the first engaging portion is detached from the second engaging portion and the elastic member is in an extended state when the lid body is in the opened state.

20 Claims, 4 Drawing Sheets

STRUCTURE WITH LID, AND STORAGE CONTAINER

CROSS-REFERENCE TO RELATED APPLICATIONS

The present disclosure claims priority to Chinese Patent Application No. 202021978477.4, filed with the Chinese Patent Office on Sep. 10, 2020, titled "STRUCTURE WITH LID, AND STORAGE CONTAINER", the entire contents of which are incorporated herein by reference.

TECHNICAL FIELD

Embodiments of the present disclosure relate to the technical field of storage containers, and in particular, relate to a structure with a lid, and a storage container.

BACKGROUND

The lid body of a household portable medication holder is generally opened by screwing or lifting. Lift-lid medication holders may be categorized into manual lift medication holders and press-to-eject medication holders. Conventional press-to-eject medication holders are generally complex in structure, and assembled by a plurality of components. Therefore, the assembling of such medication holders is complex and the medication holders may be easily damaged.

SUMMARY

In view of the above, embodiments of the present application provide a structure with a lid and a storage container. The structure with the lid can be conveniently opened and assembled, and has a simple structure.

One aspect of the embodiments of the present disclosure provides a structure with a lid, comprising a lid body, a cartridge main body, and an elastic member; wherein a first end of the lid body is rotatably connected to a side wall of the cartridge main body, such that the lid body is in a closed state or an opened state by rotation relative to the cartridge main body, and a first engaging portion is arranged at a second end of the lid body opposite to the first end; a second engaging portion engageable with the first engaging portion is arranged at a position, corresponding to the first engaging portion, of the cartridge main body, a pressing portion is connected to an outer side of the second engaging portion of the cartridge main body, and the second engaging portion is elastically deformed outwards when the pressing portion is pressed; and a first retaining slot is arranged at a bottom, proximal to the first end, of the lid body, and a second retaining slot is arranged at a top, corresponding to the first retaining slot, of the cartridge main body, and two ends of the elastic member are respectively disposed in the first retaining slot and the second retaining slot, such that the first engaging portion is engaged with the second engaging portion and the elastic member is bent to a C shape when the lid body is in the closed state, and the first engaging portion is detached from the second engaging portion and the elastic member is in an extended state when the lid body is in the opened state.

Another aspect of the embodiments of the present application provides a storage container, comprising a structure with a lid, wherein the structure with the lid comprising: a lid body, a cartridge main body, and an elastic member; a first end of the lid body is rotatably connected to a side wall of the cartridge main body, such that the lid body is in a closed state or an opened state by rotation relative to the cartridge main body, and a first engaging portion is arranged at a second end of the lid body opposite to the first end; a second engaging portion engageable with the first engaging portion is arranged at a position, corresponding to the first engaging portion, of the cartridge main body, a pressing portion is connected to an outer side of the second engaging portion of the cartridge main body, and the second engaging portion is elastically deformed outwards when the pressing portion is pressed; and a first retaining slot is arranged at a bottom of the lid body proximal to the first end, and a second retaining slot is arranged at a top, corresponding to the first retaining slot, of the cartridge main body, and two ends of the elastic member are respectively disposed in the first retaining slot and the second retaining slot, such that the first engaging portion is engaged with the second engaging portion and the elastic member is bent to a C shape when the lid body is in the closed state, and the first engaging portion is detached from the second engaging portion and the elastic member is in an extended state when the lid body is in the opened state.

During use of the structure according to the embodiments of the present application, the lid body is rotated relative to the cartridge main body, such that the lid body is switched between a closed state and an opened state. When the lid body is in the closed state, the elastic member is bend-formed into a C shape, and the first engaging portion of the lid body is engaged with the second engaging portion of the cartridge main body, such that the cartridge main body is covered with lid. When the pressing portion is pressed, the second engaging portion is elastically deformed outwards, such that the second engaging portion is detached from the first engaging portion. In this case, as a result of the elastic potential of the elastic member, the lid body is switched from the closed state to the opened state automatically. During assembling, the lid body and the cartridge main body are connected, and the two ends of the elastic member are respectively inserted into the first retaining slot and the second retaining slot to finish the assembling. In this way, the lid body can be automatically opened by pressing. The operation is convenient, the structure is simple, fewer components are used, and production and assembling are eased.

The above is merely a summary of the technical solutions of the present application. In order to make the technical solutions of the present application more clearly, so that it could be implemented, and to make the above and other purposes, features and advantages of the present application more clearly understood, detailed descriptions of the present application are provided as followed.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference signs denote like parts. In the drawings.

Figure 1:
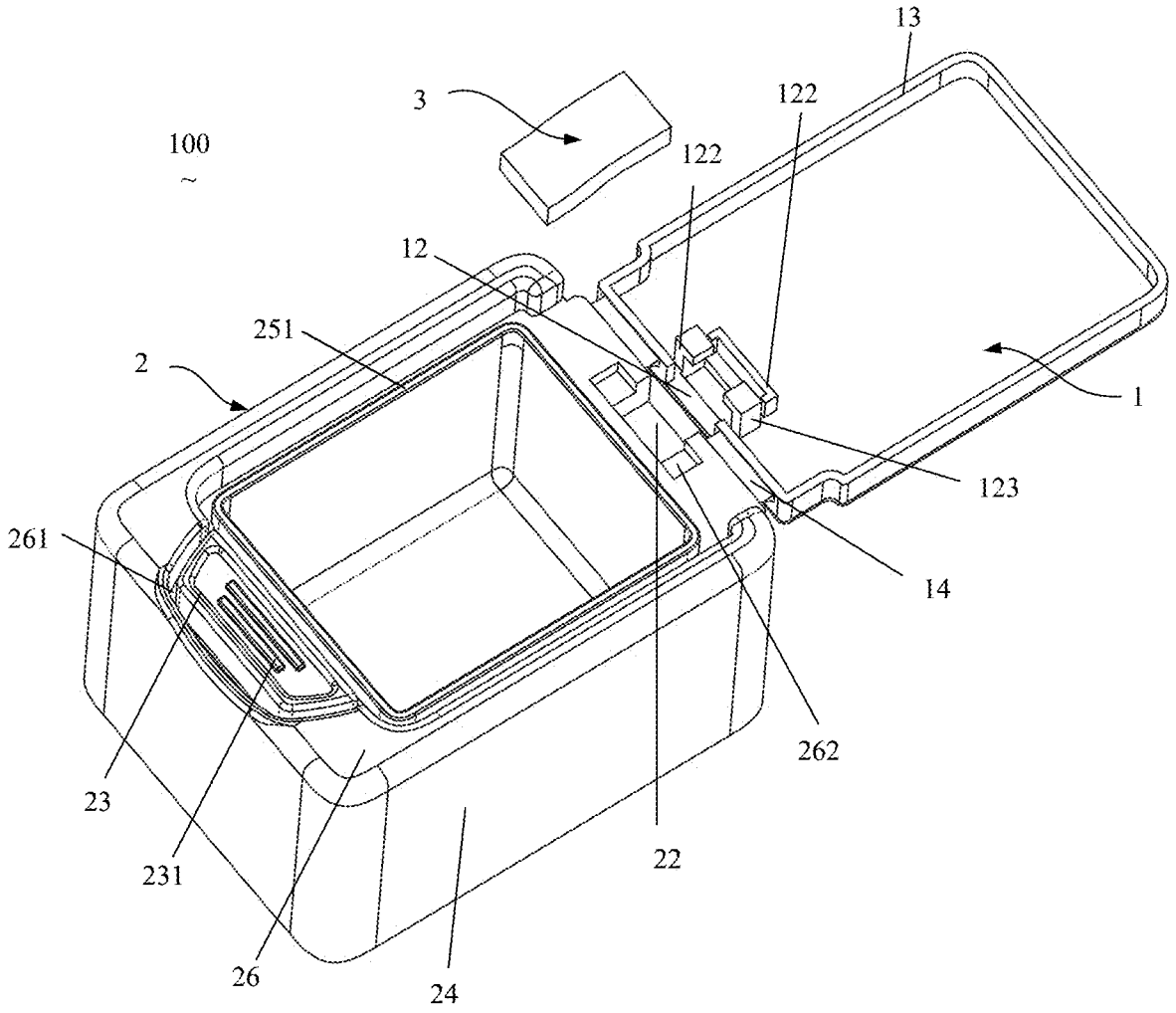
FIG. 1 is an exploded view of a container according to an embodiment of the present disclosure.

Reference numerals and denotations thereof:

1—lid body, 2—cartridge main body, 3—elastic member, 11—first engaging portion, 12—first retaining slot, 13—side plate, 14—connecting portion, 21—second engaging portion, 22—second retaining slot, 23—pressing portion, 24—outer wall, 25—inner wall, 26—connecting plate, 100—structure with lid, 121—end baffle, 122—first side baffle, 123—second side baffle, 141—stripe-shaped slot, 211—connecting arm, 221—upper baffle, 222—lower baffle, 231—anti-slide structure, 251—sealing rib, 261—avoiding opening, 262—avoiding slot, 1221—first bottom baffle, and 1231—second bottom baffle.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

Figure 2:
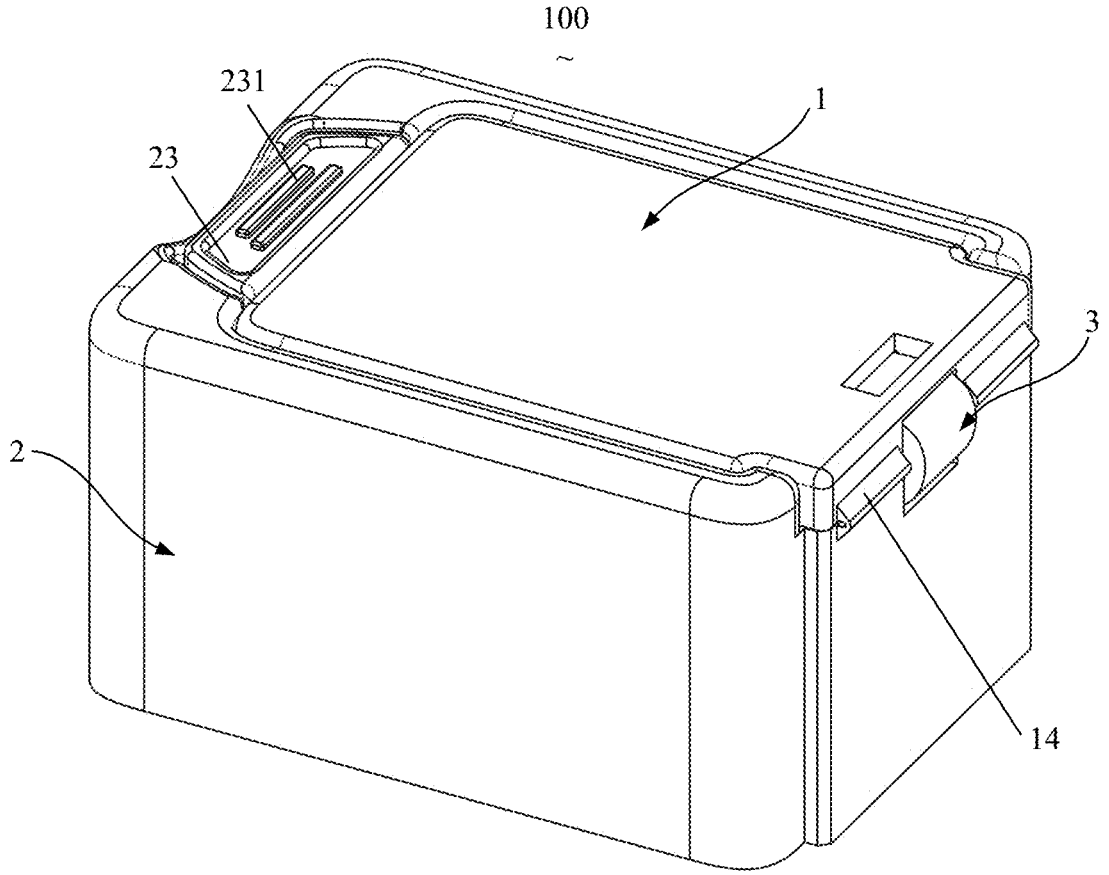
FIG. 2 is a three-dimensional view taken from one perspective when a lid body of a container is in a closed state according to an embodiment of the present disclosure.
Figure 3:
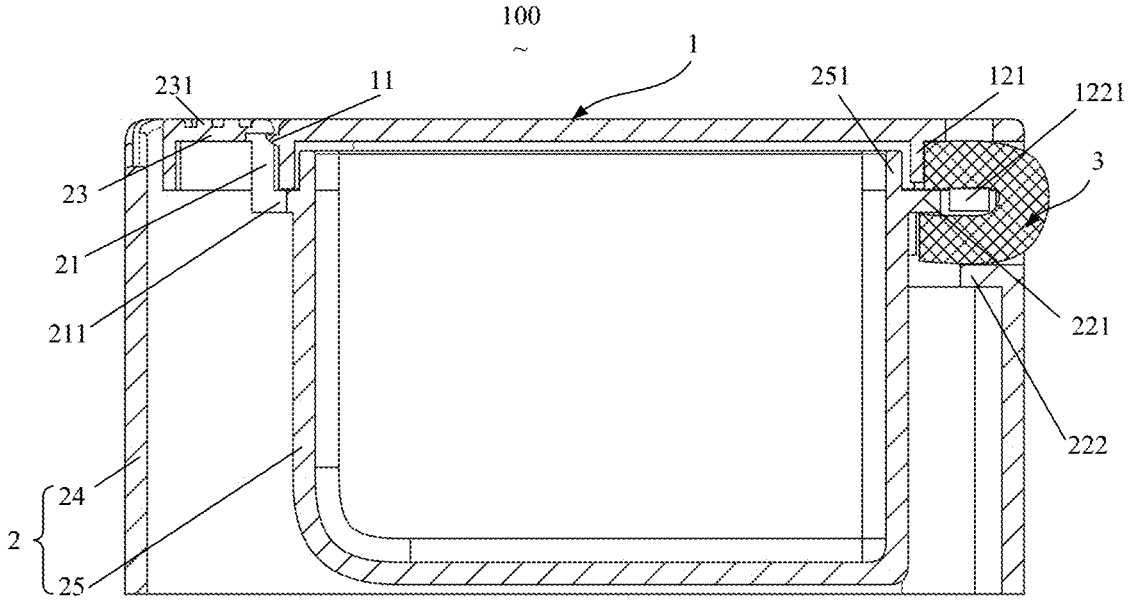
FIG. 3 is a sectional structural view taken when the lid body of the container is in the closed state according to an embodiment of the present disclosure.
Figure 4:
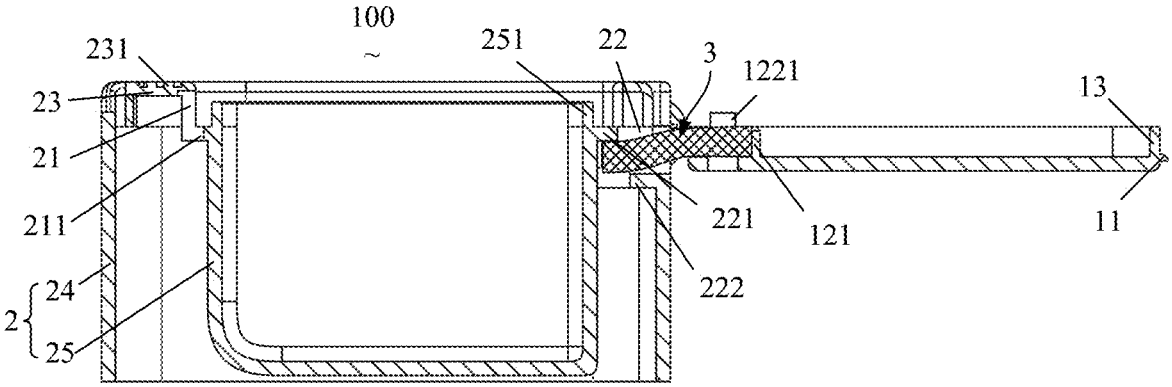
FIG. 4 is a sectional structural view taken when the lid body of the container is in an opened state according to an embodiment of the present disclosure.

Referring to FIG. 1 to FIG. 4, FIG. 1 is an exploded view of a container according to an embodiment of the present disclosure; FIG. 2 is a three-dimensional view taken from one perspective when a lid body of a container is in a closed state according to an embodiment of the present disclosure; FIG. 3 is a sectional structural view taken when the lid body of the container is in the closed state according to an embodiment of the present disclosure; and FIG. 4 is a sectional structural view taken when the lid body of the container is in an opened state according to an embodiment of the present disclosure.

A structure 100 with a lid includes a lid body 1, a cartridge main body 2, and an elastic member 3 detachably mounted at a junction between the lid body 1 and the cartridge main body 2.

A first end of the lid body 1 is rotatably connected to a side wall of the cartridge main body 2, such that the lid body 1 is in a closed state or an opened state by rotation relative to the cartridge main body 2. A first engaging portion 11 is arranged at a second end of the lid body 1 opposite to the first end.

A second engaging portion 21 engagable with the first engaging portion 11 is arranged at a position, corresponding to the first engaging portion 11, of the cartridge main body 2. A pressing portion 23 is connected to an outer side of the second engaging portion 21 of the cartridge main body 2, and the second engaging portion 21 is elastically deformed outwards when the pressing portion 23 is pressed.

A first retaining slot 12 is arranged at a bottom, proximal to the first end, of the lid body 1 and a second retaining slot 22 is arranged at a top, corresponding to the first retaining slot 12, of the cartridge main body 2, and one end of the elastic member 3 is disposed in the first retaining slot 12, and the other end of the elastic member 3 is disposed in the second retaining slot 22, such that the first engaging portion 11 is engaged with the second engaging portion 21 and the elastic member 3 is bent to a C shape when the lid body 1 is in the closed state, and the first engaging portion 11 is detached from the second engaging portion 21 and the elastic member 3 is in an extended state when the lid body 1 is in the opened state.

During use of the structure 100 with the lid according to this embodiment, the lid body 1 is rotated relative to the cartridge main body 2, such that the lid body 1 is switched between closing the cartridge main body 2 and opening the cartridge main body 2. When the lid body 1 is in a state of closing the cartridge main body 2, that is, in the closed state, the first engaging portion 11 is engaged with the second engaging portion 21, and the elastic member 3 is bend to a C shape. In this case, the elastic member 3 tends to switch the lid body 1 from the closed state to the opened state under the effect of an elastic force. When the pressing portion 23 is pressed, the second engaging portion 21 is elastically deformed outwards, such that the second engaging portion 21 is detached from the first engaging portion 11. In this case, an elastic potential after the elastic member 3 is bent is released, and the elastic member 3 is switched from a bent state to an extended state, such that the lid body 1 is switched from the closed state to the opened state. As compared with the press-type button in the related art, the pressing portion 23 is connected to the cartridge main body 2 by the second engaging portion 21, and thus few components are used.

During assembling, the lid body 1 and the cartridge main body 2 are connected, and the two ends of the elastic member 3 are respectively inserted into the first retaining slot 12 and the second retaining slot 22 to finish the assembling. In this way, the lid body 1 may be automatically opened by pressing. The operation is convenient, the structure is simple, fewer components are used, and production and assembling are eased.

In some other embodiments, the first end and the second end may also be two adjacent ends. For example, the first end is a rear end, and the second end is a left end or a right end.

Figure 5:
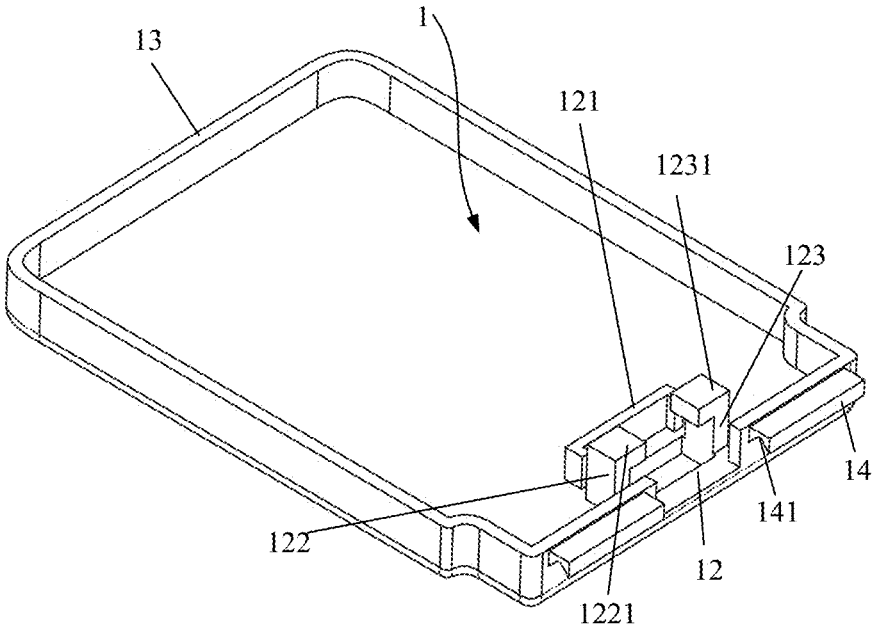
FIG. 5 is a three-dimensional view of a lid body of a structure with a lid according to an embodiment of the present disclosure.

Referring to FIG. 5, and in combination with FIG. 3 and FIG. 4, FIG. 5 illustrates a three-dimensional view of a lid body of a structure with a lid according to an embodiment of the present disclosure. In a specific embodiment, an end baffle 121, a first side baffle 122, and a second side baffle 123 are arranged in the first retaining slot 12. The end baffle 121 is opposite to a notch of the first retaining slot 12. The first side baffle 122 and the second side baffle 123 are disposed between the notch of the first retaining slot 12 and the end baffle 121 and are disposed on two sides of the first retaining slot 12. One respective ends of the end baffle 121, the first side baffle 122, and the second side baffle 123 are fixedly connected to a bottom of the lid body 1 proximal to the first end. A first bottom baffle 1221 is extended from the other end of the first side baffle 122 towards the second side baffle 123, and/or a second bottom baffle 1231 is extended from the other end of the second side baffle 123 towards the first side baffle 122. The first side baffle 122 and the second side baffle 123 are opposite to each other and enclose a slot for insertion of one end of the elastic member 3, the end baffle 121 is disposed on a side of the slot distal from the first end of the lid body 1.

In this embodiment, one end of the elastic member 3 is inserted into the slot enclosed by the first side baffle 122 and the second baffle 123, an end portion of the one end of the elastic member 3 is abutted against the end baffle 121, two opposite side walls of the elastic member 3 in the slot are respectively abutted against the first side baffle 122 and the second side baffle 123, a bottom of the elastic member 3 in the slot is abutted against the first bottom baffle 1221 and/or the second bottom baffle 1231, and a top the elastic member 3 in the slot is abutted against the bottom of the lid body 1. In this way, one end of the elastic member 3 is fixed to the first retaining slot 12, such that the elastic member 3 is prevented from detaching from the first retaining slot 12 when the lid body 1 is rotated relative to the cartridge main body 2.

Figure 6:
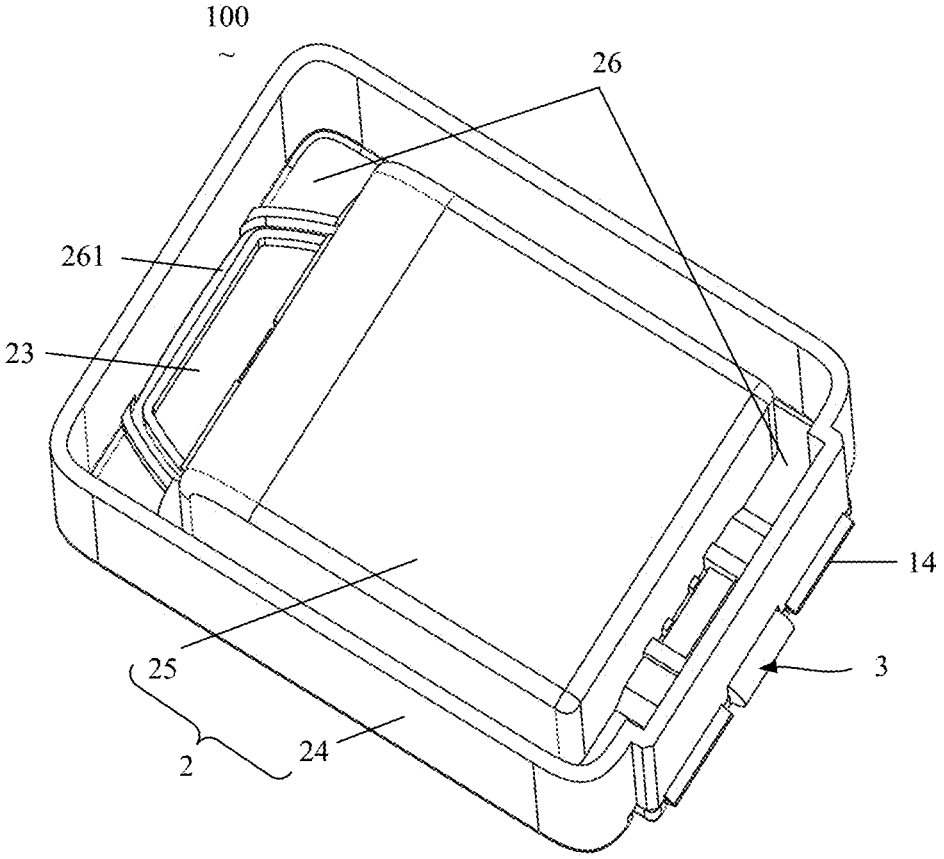
FIG. 6 is a three-dimensional view taken from another perspective when the lid body of the container is in the closed state according to an embodiment of the present disclosure.

Referring to FIG. 6, and in combination with FIG. 1 to FIG. 4, in a specific embodiment, the cartridge main body 2 includes an outer wall 24 and an inner wall 25. Tops of the outer wall 24 and the inner wall 25 are connected by a connecting plate 26. The connecting plate 26 is provided with an opening in communication with an inner cavity of the inner wall 25, and an avoiding opening 261 is arranged at a position, corresponding to the pressing portion 23, of the connecting plate 26. The avoiding opening 261 and the second retaining slot 22 are respectively disposed on two opposite sides of the opening.

In this embodiment, an opening in communication with the inner wall 25 is arranged on a connecting portion 14, such that stuff to be stored may be placed into the cavity of the inner wall 25 via the opening and stored. In addition, with the avoiding opening 261 allowing the pressing portion 23 to move arranged on the outer wall 24, the pressing portion 23 may be arranged between the inner wall 25 and the outer wall 24. This prevents the first engaging portion 11 connected to the pressing portion 23 from being directly exposed, such that the outer wall 24 may protect the first engaging portion 11, the pressing portion 23, and the inner wall 25.

In addition, an inner peripheral wall of the outer wall 24 and an outer peripheral wall of the inner wall 25 may be spaced apart to define a cavity which allows the avoiding opening 261 and the second retaining slot 22 are both in communication with the cavity, such that the outer wall 24, the inner wall 25, the avoiding opening 261 arranged on the outer wall 24 or the inner wall 25, the second retaining slot 22, and the pressing portion 23 may be integrally formed by means of a die.

Figure 7:
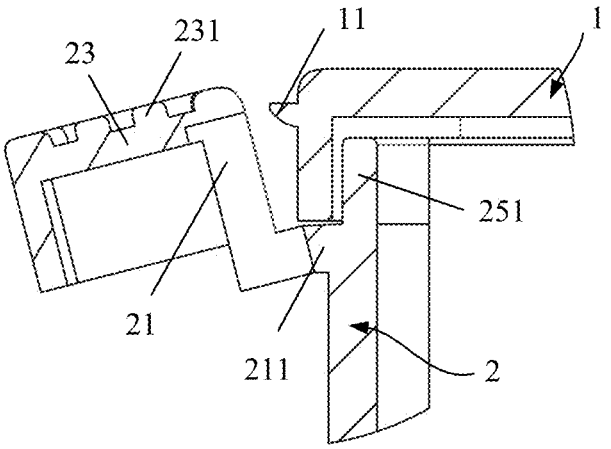
FIG. 7 is sectional structural view taken when a pressing portion of the cartridge main body is pressed according to an embodiment of the present disclosure.

Referring to FIG. 7, FIG. 7 is sectional structural view taken when a pressing portion of the container is pressed according to an embodiment of the present disclosure. In a specific embodiment, a connecting arm 211 is extended from a bottom surface of the second engaging portion 21 along the inner wall 25, and when the lid body 1 is in the closed state, the pressing portion 23 is pressed downwards and the pressing portion 23 may be swung outwards with the connecting arm 211 as a pivot, such that the first engaging portion 11 is detached from the second engaging portion 21, and the lid body 1 is automatically opened under the effect of the elastic member 3. When the pressing portion 23 is released, the pressing portion 23 may automatically restore to its original position, such that when the lid body 1 is in the closed state and the pressing portion 23 is not pressed, the first engaging portion 11 is automatically engaged with the second engaging portion 21 and thus the lid body 1 constantly is in the closed state.

Referring to the specific embodiment as illustrated in FIG. 7, an upper baffle 221 and a lower baffle 222 are arranged in the second retaining slot 22. The upper baffle 221 is fixed to the inner wall 25, and the lower baffle 222 is fixed to the outer wall 24. One end of elastic member 3, when inserted in the second retaining slot 22, is disposed between the upper baffle 221 and the lower baffle 222, and an end portion of the elastic member 3 disposed between the upper baffle 221 and the lower baffle 222 is abutted against the inner wall.

In this embodiment, under the retaining effect of the upper baffle 221 and the lower baffle 222, when the lid body 1 is rotated relative to the cartridge main body 2, the elastic member 3 may be bent or extended.

Still referring to FIG. 1 to FIG. 5, in some specific embodiments, an avoiding slot 261 is arranged at a position, corresponding to the first side baffle 122 and the second side baffle 123, of the connecting plate 26. The avoiding slot 261 is in communication with a notch of the second retaining slot 22. When the lid body 1 is in the closed state, the first side baffle 122 and the second side baffle 123 may be received in the avoiding slot 262, such that no interference is caused between the first side baffle 122 and the second side baffle 123, and an upper surface of the connecting plate 26 at the top of the cartridge main body 2, and the lid body 1 may be completely closed.

In a specific embodiment, a sealing rib 251 is extended upwards from the inner wall 25 along the opening. When the lid body 1 is in the closed state and the lid body 1 closes the opening, an upper surface of the sealing rib 251 is abutted against an inner surface of the bottom of the lid body 1, such that when the lid body 1 closes the opening, a slit between a periphery of the opening and the lid body 1 may be sealed.

In a specific embodiment, a side plate 13 is extended downwards from the lid body 1. When the lid body 1 is in the closed state, the side plate 13 is disposed on an outer periphery of the sealing rib 251. The first engaging portion 11 is arranged on the other outer side wall opposite to an outer side wall of the side plate 13 rotatably connected to the cartridge main body 2. By the side plate 13, when the lid body 1 closes the opening, the side plate 13 may enclose a perimeter of the sealing rib 251, such that the periphery of the opening is further enclosed and protected.

Specifically, a receiving space configured to receive the lid body 1 is recessed downwards on the connecting plate 26. The sealing rib 251 is received in the receiving space, and an outer peripheral wall of the sealing rib 251 and an inner peripheral wall of the receiving space are spaced apart to define a receiving slot. When the lid body 1 is in the closed state, the lid body 1 is disposed in the receiving space, and the side plate 13 of the lid body 1 is also disposed in the receiving slot, such that in the closed state, the side plate 13 of the lid body 1 and the inner wall 25 are both enclosed and protected by the outer wall 24. In the meantime, this improves consistency in terms of product appearance, such that the product is cleaner and more elegant.

With respect to the first engaging portion 11 and the second engaging portion 21, one of the first engaging portion 11 and the second engaging portion 21 is provided with a groove, and the other thereof is provided with a protrusion. When the lid body 1 is in the closed state, by concave-convex engagement and fitting, when the pressing portion 23 is not pressed, the lid body 1 and the cartridge main body 2 are constantly in the closed state.

In a specific embodiment, the top of the pressing portion 23 is further provided with an anti-slide structure 231. By the anti-slide structure 231, a friction force between the pressing portion 23 and a finger may be increased, thereby preventing slides when pressing the pressing portion 23. Specifically, the anti-slide structure 231 may be a plurality of groove structures deployed on an upper surface of the pressing portion 23. For example, the anti-slide structure 231 may be a plurality of elongated protrusions parallelly arranged on the top of the pressing portion 23.

In a specific embodiment, the lid body 1 and the cartridge main body 2 are integrally formed. Specifically, the first end of the lid body 1 is provided with a connecting portion 14. One end of the connecting portion 14 is connected to the lid body 1, the other end of the connecting portion 14 is provided with a side wall of the second retaining slot 22, and a middle part of the connecting portion 14 is provided with a stripe-shaped groove 141, such that an axial line about which the two ends may be rotated is defined in the middle part of the connecting portion 14. The connecting portion 14 and the lid body 1, and the cartridge main body 2 are integrally formed from a plastic material. One end of the connecting portion 14 is fixedly connected to a side of the outer wall 24 provided with the second retaining slot 22, and the other end of the connecting portion 14 is connected to a side plate 13 of the lid body 1 provided with the first retaining slot 12. The connecting portion 14 is arranged on another wall of the side plate 13 opposite to the first engaging portion 11.

In this embodiment, by the stripe-shaped groove 141 arranged in the middle part of the connecting portion 14, a thickness of the middle part of the connecting portion 14 is less than thicknesses of the two ends of the connecting portion 14, such that the middle part has a better flexibility. In this way, the two ends of the connecting portion 14 is capable of moving relative to each other by means of the flexibility of the middle part, such that the lid body 1 and the cartridge main body 2 may be rotatably connected by the connecting portion 14.

It may be understood that the connecting portion 14 may be a hinge, a connecting rotational shaft, or the like hinge structure which rotatably connect the lid body 1 to the cartridge main body 2.

In a specific embodiment, two connecting portions 14 may be arranged, and the two connecting portions 14 are spaced apart at the first end of the cartridge main body 2. The second retaining slot 22 is arranged between the two connecting portions 14. The first retaining slot 12 is disposed between the two connecting portions 14 on the lid body 1, and the position of the first retaining slot 12 on the lid body 1 is opposite to the position of the second retaining slot 22 on the cartridge main body 2. In this way, when the elastic member 3 and the lid body 1 are assembled with the cartridge main body 2, the elastic member 3 is disposed between the two connecting portions 14. When the elastic member 3 causes, by an elastic force, the lid body 1 to rotate relative to the cartridge main body 2, the two connecting portions 14 may balance a torque applied to the connecting portion 14 when the elastic member 3 pushes the lid body 1 to rotate.

In a specific embodiment, the elastic member 3 may be a silicone stripe or a metal elastic sheet. The silicone stripe and the metal elastic sheet have good elasticity and a simple structure, such that the lid body 1 and a mounting structure, configured to fix the elastic member 3, arranged on the cartridge main body 2 is simplified, which facilitates simplification of the entire structure and reduction of the use cost of the elastic member 3. It should be noted that in some other embodiments, the elastic member 3 may also be a torsion spring.

In another aspect of the present disclosure, a storage container is provided. The storage container includes the structure 100 with the lid according to the above embodiments. The storage container may be a medication holder, a bottle, a package box, or the like product with a lid structure. The storage container may achieve the same beneficial effect as the structure 100 with the lid according to the above embodiments, which are not described herein any further.

It should be noted that unless otherwise specified, the technical terms and scientific terms used in the present disclosure shall express general meanings that may be understood by a person skilled in the art.

In the description of the present disclosure, it should be understood that the terms "length", "width", "upper", "lower", "top", "bottom", "inner", "outer" and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In addition, terms of "first", "second", and the like are only used for description, but shall not be understood as indication or implication of relative importance or implicit indication of the number of the specific technical features.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope defined by the claims and the specification of the present disclosure. Especially, various technical features mentioned in various embodiments may be combined in any fashion as long as there is no structural conflict. The present disclosure is not limited to the specific embodiments described herein in this specification, but also includes all the technical solutions falling within the scope subject to the appended claims.

What is claimed is:

1. A structure with a lid, comprising: a lid body, a cartridge main body, and an elastic member; wherein a first end of the lid body is rotatably connected to a side wall of the cartridge main body, such that the lid body is in a closed state or an opened state by rotation relative to the cartridge main body, and a first engaging portion is arranged at a second end of the lid body opposite to the first end;

a second engaging portion engageable with the first engaging portion is arranged at a position, corresponding to the first engaging portion, of the cartridge main body, a pressing portion is connected to an outer side of the second engaging portion of the cartridge main body, and the second engaging portion is elastically deformed outwards when the pressing portion is pressed; and a first retaining slot is arranged at a bottom, proximal to the first end, of the lid body, and a second retaining slot is arranged at a top, corresponding to the first retaining slot, of the cartridge main body, and two ends of the elastic member are respectively disposed in the first retaining slot and the second retaining slot, such that the first engaging portion is engaged with the second engaging portion and the elastic member is bent to a C shape when the lid body is in the closed state, and the first engaging portion is detached from the second engaging portion and the elastic member is in an extended state when the lid body is in the opened state.

2. The structure with the lid according to claim 1, wherein an end baffle, a first side baffle, and a second side baffle are arranged in the first retaining slot; wherein the end baffle is opposite to a notch of the first retaining slot, and the first side baffle and the second side baffle are disposed between the notch of the first retaining slot and the end baffle and are disposed on two sides of the first retaining slot; and a first bottom baffle is extended from a bottom of the first side baffle towards the second side baffle, and the first bottom baffle is abutted against a side of the elastic member going away from the lid body.

3. The structure with the lid according to claim 1, wherein an end baffle, a first side baffle, and a second side baffle are arranged in the first retaining slot; wherein the end baffle is opposite to a notch of the first retaining slot, and the first side baffle and the second side baffle are disposed between the notch of the first retaining slot and the end baffle and are disposed on two sides of the first retaining slot; and a second bottom baffle is extended from a bottom of the second side baffle towards the first side baffle, and the second bottom baffle is abutted against the side of the elastic member going away from the lid body.

4. The structure with the lid according to claim 1, wherein the cartridge main body comprises an outer wall and an inner wall, tops of the outer wall and the inner wall are connected by a connecting plate, the connecting plate is provided with an opening in communication with an inner cavity of the inner wall, and an avoiding opening is arranged at a position, corresponding to the pressing portion, of the connecting plate; and the second retaining slot is arranged on the connecting plate, and the second retaining slot and the avoiding opening are respectively disposed on two opposite sides of the opening.

5. The structure with the lid according to claim 4, wherein an upper baffle and a lower baffle are arranged in the second retaining slot, the upper baffle is fixed to the inner wall, the lower baffle is fixed to the outer wall, and one end of the elastic member, when inserted in the second retaining slot, is disposed between the upper baffle and the lower baffle.

6. The structure with the lid according to claim 5, wherein a sealing rib is extended upwards from the inner wall along the opening, and the bottom of the lid body is abutted against an upper surface of the sealing rib when the lid body is in the closed state.

7. The structure with the lid according to claim 6, wherein a side plate is extended downwards from the lid body, and the side plate is disposed on an outer periphery of the sealing rib when the lid body is in the closed state.

8. The structure with the lid according to claim 1, wherein one of the first engaging portion and the second engaging portion is provided with a groove, and the other is provided with a protrusion.

9. The structure with the lid according to claim 1, wherein an anti-slide structure is arranged at a top of the pressing portion.

10. The structure with the lid according to claim 1, wherein the lid body and the cartridge main body are integrally formed.

11. A storage container, comprising a structure with a lid, wherein the structure with the lid comprising: a lid body, a cartridge main body, and an elastic member;

a first end of the lid body is rotatably connected to a side wall of the cartridge main body, such that the lid body is in a closed state or an opened state by rotation relative to the cartridge main body, and a first engaging portion is arranged at a second end of the lid body opposite to the first end;

a second engaging portion engageable with the first engaging portion is arranged at a position, corresponding to the first engaging portion, of the cartridge main body, a pressing portion is connected to an outer side of the second engaging portion of the cartridge main body, and the second engaging portion is elastically deformed outwards when the pressing portion is pressed; and a first retaining slot is arranged at a bottom of the lid body proximal to the first end, and a second retaining slot is arranged at a top, corresponding to the first retaining slot, of the cartridge main body, and two ends of the elastic member are respectively disposed in the first retaining slot and the second retaining slot, such that the first engaging portion is engaged with the second engaging portion and the elastic member is bent to a C shape when the lid body is in the closed state, and the first engaging portion is detached from the second engaging portion and the elastic member is in an extended state when the lid body is in the opened state.

12. The storage container according to claim 11, wherein an end baffle, a first side baffle, and a second side baffle are arranged in the first retaining slot; wherein the end baffle is opposite to a notch of the first retaining slot, and the first side baffle and the second side baffle are disposed between the notch of the first retaining slot and the end baffle and are disposed on two sides of the first retaining slot;

a first bottom baffle is extended from a bottom of the first side baffle towards the second side baffle, and the first bottom baffle is abutted against a side of the elastic member going away from the lid body.

13. The storage container according to claim 11, wherein an end baffle, a first side baffle, and a second side baffle are arranged in the first retaining slot; wherein the end baffle is opposite to a notch of the first retaining slot, and the first side baffle and the second side baffle are disposed between the notch of the first retaining slot and the end baffle and are disposed on two sides of the first retaining slot;

a second bottom baffle is extended from a bottom of the second side baffle towards the first side baffle, and the second bottom baffle is abutted against the side of the elastic member going away from the lid body.

14. The storage container according to claim 11, wherein the cartridge main body comprises an outer wall and an inner wall, tops of the outer wall and the inner wall are connected by a connecting plate, the connecting plate is provided with an opening in communication with an inner cavity of the inner wall, and an avoiding opening is arranged at a position, corresponding to the pressing portion, of the connecting plate; and the second retaining slot is arranged on the connecting plate, and the second retaining slot and the avoiding opening are respectively disposed on two opposite sides of the opening.

15. The storage container according to claim 14, wherein an upper baffle and a lower baffle are arranged in the second retaining slot, the upper baffle is fixed to the inner wall, the lower baffle is fixed to the outer wall, and one end of the elastic member, when inserted in the second retaining slot, is disposed between the upper baffle and the lower baffle.

16. The storage container according to claim 15, wherein a sealing rib is extended upwards from the inner wall along the opening, and the bottom of the lid body is abutted against an upper surface of the sealing rib when the lid body is in the closed state.

17. The storage container according to claim 16, wherein a side plate is extended downwards from the lid body, and the side plate is disposed on an outer periphery of the sealing rib when the lid body is in the closed state.

18. The storage container according to claim 11, wherein one of the first engaging portion and the second engaging portion is provided with a groove, and the other is provided with a protrusion.

19. The storage container according to claim 11, wherein an anti-slide structure is arranged at a top of the pressing portion.

20. The storage container according to claim 11, wherein the lid body and the cartridge main body are integrally formed.

* * * * *